US006707988B2

(12) United States Patent
Reusche et al.

(10) Patent No.: US 6,707,988 B2
(45) Date of Patent: Mar. 16, 2004

(54) UNIVERSAL DRAIN PLUG HEATER FOR LIVESTOCK WATER TANKS

(75) Inventors: Thomas K. Reusche, Elburn, IL (US); Donald B. Owen, Batavia, IL (US)

(73) Assignee: Allied Precision Industries, Inc., Elburn, IL (US)

( * ) Notice: Subject to any disclaimer, the term of this patent is extended or adjusted under 35 U.S.C. 154(b) by 0 days.

(21) Appl. No.: 10/170,669

(22) Filed: Jun. 13, 2002

(65) Prior Publication Data

US 2003/0031472 A1 Feb. 13, 2003

Related U.S. Application Data

(60) Provisional application No. 60/297,961, filed on Jun. 13, 2001.

(51) Int. Cl.[7] ..... F24H 1/20; H05B 3/78

(52) U.S. Cl. ..... 392/455; 392/501

(58) Field of Search ..... 392/807, 841, 392/444, 448, 455

(56) References Cited

U.S. PATENT DOCUMENTS

| | | | | |
|---|---|---|---|---|
| 1,817,850 A | * | 8/1931 | Schwalbach | 219/205 |
| 3,213,263 A | * | 10/1965 | Steenbergen | 219/205 |
| 3,641,473 A | | 2/1972 | Attaway | |
| 3,746,836 A | | 7/1973 | Summerfield et al. | |
| 4,068,116 A | | 1/1978 | McKinstry | |
| 4,124,793 A | | 11/1978 | Colman | |
| 4,835,366 A | * | 5/1989 | Owen et al. | 392/499 |
| 4,848,616 A | | 7/1989 | Nozaki | |
| 4,946,396 A | | 8/1990 | Saitoh | |
| 5,109,474 A | | 4/1992 | Cameron | |
| 5,159,659 A | | 10/1992 | Cameron | |
| 5,191,634 A | | 3/1993 | Couch | |
| 5,305,419 A | | 4/1994 | Cameron | |
| 5,395,264 A | | 3/1995 | Keith | |
| 5,462,452 A | | 10/1995 | Devine | |
| 5,828,810 A | | 10/1998 | Frank et al. | |
| 5,990,455 A | | 11/1999 | Scott et al. | |
| 6,028,294 A | | 2/2000 | Nilson | |
| 6,072,152 A | * | 6/2000 | Landry | 219/202 |
| 6,151,448 A | | 11/2000 | Reusche et al. | |

OTHER PUBLICATIONS

Product brochure from Allied Precision Industries, Inc. entitled "Allied De–Icers and Heaters"; Copyright 1997.

Web page for Farm Innovators Inc. showing Drain Plug De–Icer Model DPH–15. (This was published more than one year prior to the Jun. 13, 2001 priority date of the provisional application Ser. No. 60/297,961.

* cited by examiner

*Primary Examiner*—Sang Y. Paik
*Assistant Examiner*—Thor Campbell
(74) *Attorney, Agent, or Firm*—McAndrews, Held & Malloy, Ltd.

(57) ABSTRACT

An electric water heater for use with a livestock water tank includes a heating element, a housing including a drain plug fitting, and a power cord. The power cord is interconnected with the heating element through a temperature control device, e.g. a thermostat, for delivering electrical power to the heating element in a controlled fashion so as to regulate the temperature of the contents of the tank. The heating element and housing are sized and configured for insertion through the drain plug opening from the outside of the tank. The housing includes a drain plug fitting for affixing the heater to the tank through the drain plug opening in a sealed manner, thereby preventing inadvertent removal of the heater and also preventing the contents of the tank from leaking out of the drain plug opening. The fitting includes a threaded portion or boss sized for insertion through the drain plug opening and a back wall which is larger than that of the drain plug opening.

11 Claims, 5 Drawing Sheets

UNIVERSAL DRAIN PLUG HEATER FOR LIVESTOCK WATER TANKS

RELATED APPLICATIONS

This application is related to, and claims priority from, Provisional Application No. 60/297,961 filed Jun. 13, 2001, titled "Universal Drain Plug heater For Livestock Water Tanks," the complete subject matter of which is incorporated herein by reference in its entirety.

BACKGROUND OF THE INVENTION

This invention relates generally to electric water heaters, and more particularly to electric water heaters for use in livestock water tanks exposed to low temperature extremes.

Livestock require large amounts of water throughout the year. In order to provide livestock with needed water during winter months, exterior livestock watering tanks are seasonally equipped with electric water heaters to prevent the water contained therein from icing over during cold temperatures. These heaters either float in the tank or rest on the bottom of the tank. The power cord extends from the heater and over the side wall of the tank for connection to a power outlet. Because the heater is not fixed in the tank in these prior designs, it is possible for the heater to be thrown from the tank when an animal drags on the power cord.

Commercially available water tanks typically include a drain opening in their side wall so that the tanks can be drained, e.g. for transporting or so it can be refilled with fresh water. It is desirable to have a tank heater in which the power cord extends from the tank through the drain opening so that cord is out of reach of the livestock. However, the size of the drain plug opening varies depending on the manufacturer, and in many instances the drain openings are too small to permit the male plug of the power cord to be inserted through the opening. As a result, there is a need for a tank heater that can be mounted through a variety of sizes of drain plug openings without modifying the drain plug or the water heater.

In response to this problem, U.S. Pat. No. 6,151,448 discloses the use of "split" cord construction. However, this split cord construction requires the use of extra components, and, hence, it is relatively expensive to manufacture. Additionally, if the detachable section of the power cord is damaged or misplaced the heater will be rendering inoperable.

BRIEF SUMMARY OF THE INVENTION

According to certain aspects of an embodiment of the present invention, an electric heater for mounting through the drain plug opening of a livestock water tank includes an electrical heating element sized for insertion through the drain plug opening, a male plug adapted for connection to a conventional electrical outlet, and a power cord extending between the electrical heating element and the male plug. A drain plug fitting is connected to the proximal end of the heating element and is adapted for insertion into the drain plug opening, the drain plug fitting include a seal adapted to seal the drain plug opening to prevent water leakage though the opening.

According to one embodiment, the heating element may have a maximum outer cross sectional dimension of 0.75 inches or smaller.

The heater may also include a temperature regulating device interconnected between the power cord and the heating element, which is adapted to regulate the heating element so as to maintain the contents of the tank within a preselected temperature range.

According other aspects of an embodiment of the present invention, an electric water heating apparatus for mounting in a water tank having a drain plug opening includes a housing having a back wall which is larger than the drain plug opening and body portion extending from the back wall, the body portion being sized for insertion through the drain plug opening including a threaded portion. An electric heating element extends from the end of the body portion opposite the back wall. The heating element is sized for insertion through the drain plug opening and is configured for immersion into the contents of the tank. A power cord has one end mechanically and electrically connected to a male plug. The other end of the power cord extends into the housing is electrically interconnected with the heating element for delivering power thereto. A fastener, such as a nut, threads onto the threaded portion of the housing from inside the tank to secure the heating element within the tank. A seal is provided to seal the drain plug opening around the housing to prevent leakage therethrough. A temperature regulating device is interconnected between the power cord and the heating element. The temperature regulating device is adapted to regulate the heating element so as to maintain the contents of the tank within a preselected temperature range.

The seal may be an annular washer which is compressed between the water tank side wall and the back wall as the nut is threaded onto the boss.

Figure 1:
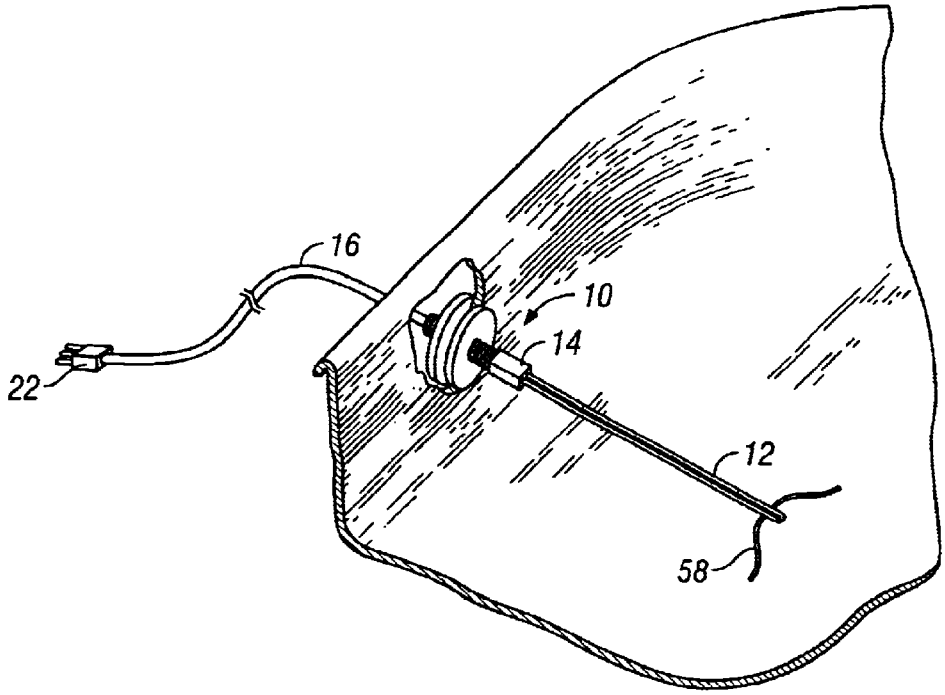
FIG. 1 is a perspective view of a drain plug heater in accordance with certain aspects of an embodiment of the present invention, showing the heater installed through the drain plug opening of a watering tank.

The foregoing summary, as well as the following detailed description of certain embodiments of the present invention, will be better understood when read in conjunction with the appended drawings. For the purpose of illustrating the invention, there is shown in the drawings, certain embodiments. It should be understood, however, that the present invention is not limited to the arrangements and instrumentality shown in the attached drawings.

DETAILED DESCRIPTION OF THE INVENTION

Referring now to the drawings, an electric drain plug heater 10 in accordance with certain aspects of an embodiment of the present invention includes a heating element 12, a housing 14, and a power cord 16. The power cord 16 is interconnected with the heating element 12 through a temperature control device, e.g. a thermostat, for delivering electrical power to the heating element 12 in a controlled fashion so as to regulate the temperature of the contents of the tank 20. The power cord 16 extends from the housing 14 and terminates in a conventional male plug 22, which is configured for insertion into a conventional power outlet (not shown). The heater housing 14 hermetically seals the interconnection temperature control device 18, the power cord 16, and the heating element 12 from moisture infiltration. The heating element 12 and at least a portion of the housing 14 are configured for insertion through the drain plug opening 23 from the outside of the tank 20.

The housing includes a drain plug fitting 24 for affixing the heater 10 to the tank 20 through the drain plug opening in a sealed manner, thereby preventing inadvertent removal of the heater 10 and also preventing the contents of the tank 20 from leaking out of the drain plug opening 23. The fitting 24 includes a threaded portion or boss 26, which is sized for insertion through the drain plug opening 23. The housing 14 also includes a back wall or plate 28 having a diameter which is larger than that of the drain plug opening. The power cord 16 extends from the back wall 28 of the housing 14 opposite the boss 26. The heating element 12 extends from housing 14 on the side opposite that of the power cord 16. The heater 10 is installed into the drain plug opening by inserting the heating element 12 and the housing 14 through the drain plug opening from the outside of the tank 20 until the back wall 28 abuts the outer surface of the tank 20. A rubber gasket or washer 30 is positioned between the back wall 28 and the wall 32 of the tank 20 to seal around the drain plug opening 23. A reciprocal nut or fastener 34 threads onto the threaded portion 26 of the housing 14 from inside of the tank 20 to secure the housing 14 to the tank 20.

Figure 2:
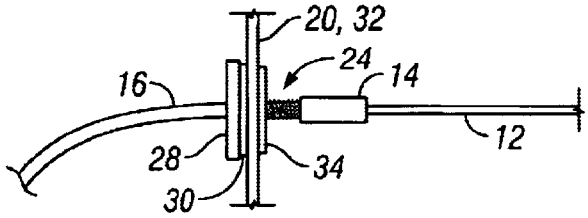
FIG. 2 is a cross sectional view showing the drain plug heater of FIG. 1 installed through the drain plug opening of a watering tank.
Figure 9:
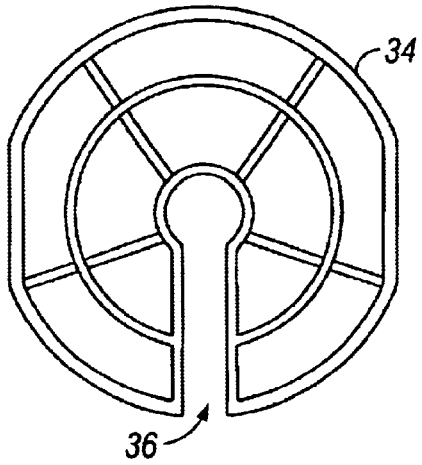
FIGS. 9 and 10 show front and back views of a nut employed in accordance with certain aspects of the present invention.
Figure 10:
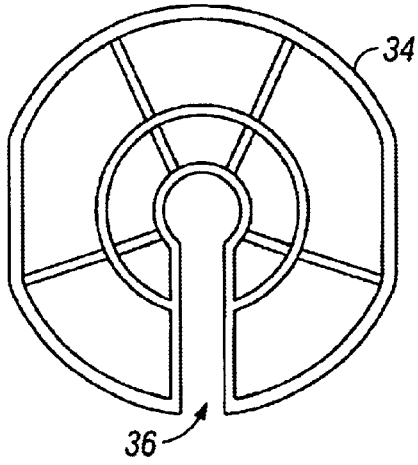

The nut 34 may be constructed in accordance with the nut described in U.S. Pat. No. 6,151,448, the disclosure of which is hereby incorporated by reference. The nut 34 includes a slot (see FIGS. 9 and 10) which is sized to slide over a necked down portion 38 of the housing 14. The necked down portion 38 is located at the distal end of the threaded portion 26. The nut 34 is installed by sliding its slot 36 over the necked down portion 38 and then threading it onto the threaded portion 26 to tighten it against the wall 32 of the tank 20. The rubber gasket 30 fits around the threaded portion 26 and, as is shown in FIG. 2, is compressed between the housing 14 and the tank wall 32 as the nut 34 is tightened onto the threaded portion 26 of the housing 14. Alternatively, the gasket 30 may be positioned on the inside of the tank 20, between the nut 34 and the tank wall 32. The gasket 30 can also be slotted to allow it to be slid laterally into place over the threaded portion 26. The heating element 12 can also be formed of a smaller diameter to allow the nut 34 to be slid over the distal end of the heating element 12 and tighten onto the housing 14, thereby eliminating the need for a "slotted" nut.

Figure 5:
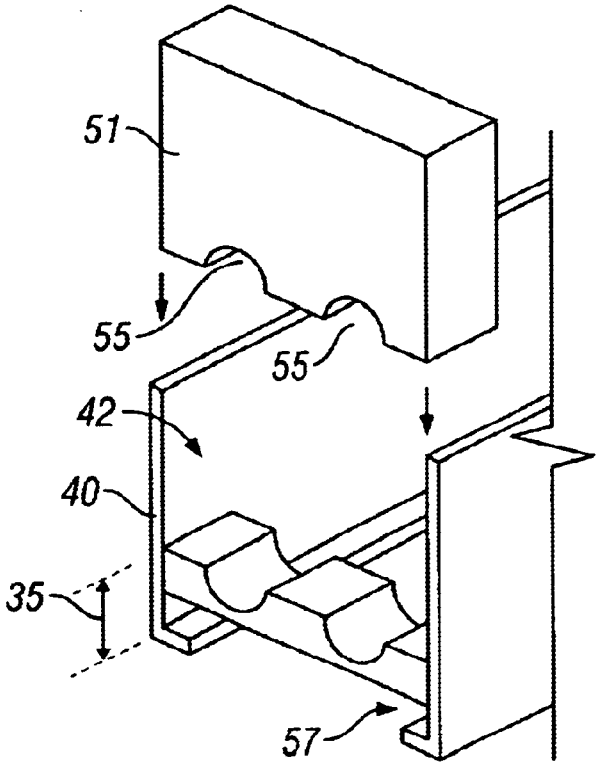
FIG. 5 is a partial perspective view of the heater side of potting box of the drain plug heater of FIG. 1.

The tank heater 10 may be configured for use in water tanks having drain plug openings ranging from 0.75 inches in diameter to 2.0 inches in diameter. In this respect, both the housing 14 and the heating element 12 preferably have a respective maximum outer cross-sectional dimension (see, e.g., reference number 35 in FIG. 5) which is less than 0.75 inches, and most preferably on the order of 0.65 inches or less. The gasket 30 preferably has an inner diameter which approximates the outer diameter of the threaded portion 26, and an outer diameter which is greater than the largest drain plug opening for which the heater is designed to accommodate. Therefore, in the present example the gasket 30 has an outer diameter which is greater than 2.0 inches. The back wall 28 of the housing 14 is also configured to extend beyond the edge of a 2 inch diameter drain plug opening. In this respect, the outer diameter of both the nut 34 and the back wall 28 may be on the order of between 2.75 and 3.25 inches.

Although the housing 24 has been illustrated with a planar, circular back wall 28, it will be appreciated that other housing configurations are also suitable. For example, the back wall can be rectangular. Alternatively, the housing 14 can have a cone-shaped back wall (not shown) which configured to fit into drain plug openings of varying diameters. In such a design, a cone-shaped gasket (not shown) can be provided to fit over the cone-shaped back wall to seal the drain opening. The gasket can be a separate component from the housing or it can be in the form of a layer of gasket material bonded to the outside of the housing. Alternatively, the nut could be cone or funnel shaped.

The power cord 16 includes an outer insulating sheath 100 enclosing a line or "hot" conducting wire 102, a neutral conducting wire 104, and a ground conducting wire 106. Each wire is further provided with its own insulating sheath. The distal end of the power cord is connected to conventional three-prong electrical plug 22. Three prongs extend from the front face of the plug 22 and are oriented for insertion into a convention power outlet. In particular, the plug includes a line prong 112, a neutral prong 114, and a ground prong 116. The power cord 16 extends from the rear of the plug 22 with the sheath 100 of the power cord being encapsulated within the body of the plug 22. Within the plug 22, the sheath has been removed to allow the wires to be separated for interconnection with the appropriate conductive prongs. In particular, the line wire 102 is electrically and mechanically interconnected with the line prong 112, the neutral wire 104 is electrically and mechanically interconnected with the neutral prong 114, and the ground wire 106 is electrically and mechanically interconnected with the ground prong 116.

Figure 3:
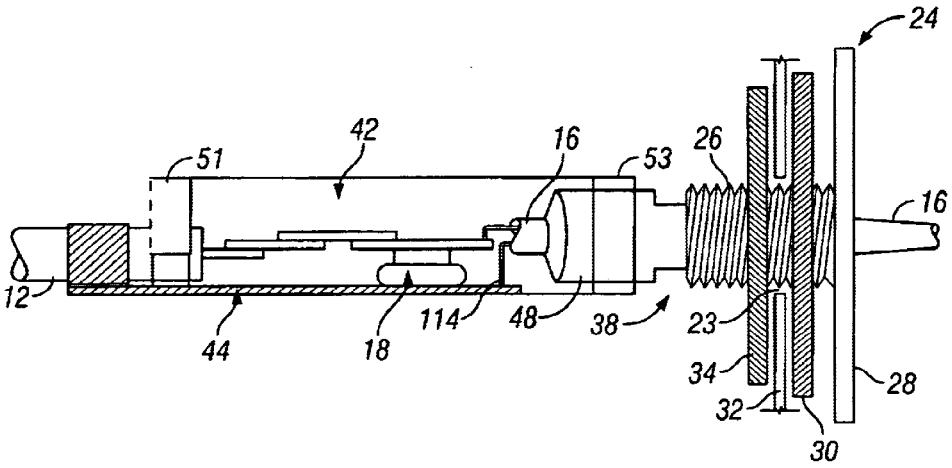
FIG. 3 is a partial cross-sectional view of the drain plug heater of FIG. 1.
Figure 8:
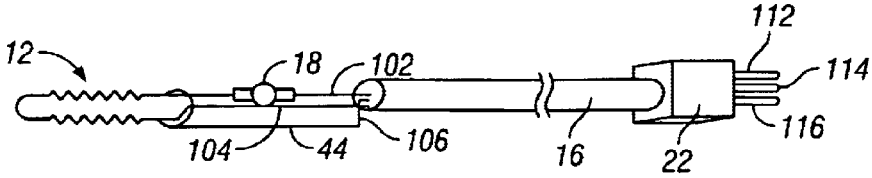
FIG. 8 is an electrical diagram for the heater of FIG. 1.

The proximal end of the power cord extends into the housing 14 where it is electrically interconnected with the heating element 12 and the temperature control device 18. (See generally FIGS. 3 and 8). The housing 14 may include an outer shell or potting box 40, which defines an inner cavity 42 enclosing the interconnection between the power cord 16, the temperature control device 18, and the heating element 12. The outer shell may be formed from a suitable material such as plastic in a conventional manner such as injection molding. The inner cavity 42 is hermetically sealed by filling it with a suitable waterproof sealant such as epoxy resin or a silicone sealing material.

Figure 7A:
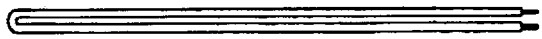
FIGS. 7A–7C illustrate some of the alternative shapes for the heating element employed in the heater of FIG. 1.
Figure 7B:
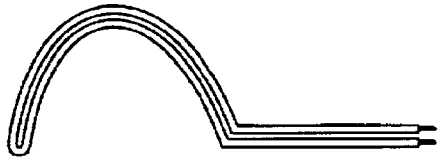
Figure 7C:
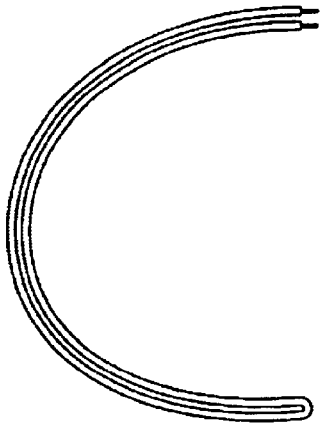

The heating element 12 is in the form of an elongated tubular member which is looped back along itself such that the first and second ends of the heating element are positioned within the housing 14 where they are appropriately interconnected with the power cord 16. In particular, the first end of the heating element 12 is connected to the proximal end of the line wire 102 through the temperature control device 18 and the second end of the heating element 12 is connected to the neutral conductor wire 104. The ground conductor wire is connected to a thermally conductive temperature feedback strap 44. FIGS. 7A–7C illustrate some of the suitable alternative shapes for the heating element 12. Preferably, the legs of the heating element substantially abut one another or are in close proximity, so as to minimize the outer cross-sectional dimension of the heating element 12.

The heating element in FIGS. 7B and 7C are curved, which is preferable because it increases the overall length of the heating element which can be used, thereby increasing heat distribution within the tank.

The temperature control device 18 is in the form of a thermostat or temperature responsive switch that is interposed between the heating element 12 and the power cord 16. The temperature control device 18 is disposed within the cavity 42 of the housing 14 and has a first terminal and a second terminal. The first terminal is connected to the proximal end of the line wire 102 and the second terminal is connected to the first end of the elongated heating element 12. The temperature control device 18 senses the temperature of the contents of the tank 20 through the thermally conductive strap 44 and cycles the heating element 12 on and off to maintain the contents of the tank 20 within a predetermined temperature range. In particular, the temperature control device 18 turns on the heating element 12 when the temperature of the contents of the tank fall below a lower set point, which in the preferred embodiment is on the order of 40° F. Conversely, the temperature control device 18 turns the heating element 12 off when the temperature of the contents of the tank rise above an upper set point, which in the preferred embodiment is on the order of 60° F. A suitable temperature control device 18 is constructed in accordance with U.S. Pat. No. 4,835,366, the contents of which are hereby incorporated by reference. The thermally conductive strap 44 is affixed in a thermally conductive manner to the temperature control device 18 and functions as a temperature feedback strap for the thermostat. The strap 44 is exposed on its lower face to the water in the tank 20 and its distal end is affixed to the elongated heating element 12. The thermal feedback strap 44 could be various shapes and may only be attached to the bottom of the element as opposed to the bottom three sides of the heating element, as shown.

Figure 4:
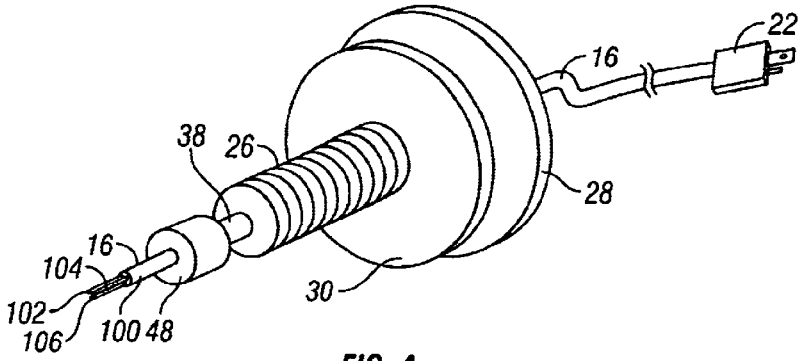
FIG. 4 is a partial perspective view of a drain plug fitting of the drain plug heater of FIG. 1.
Figure 6:
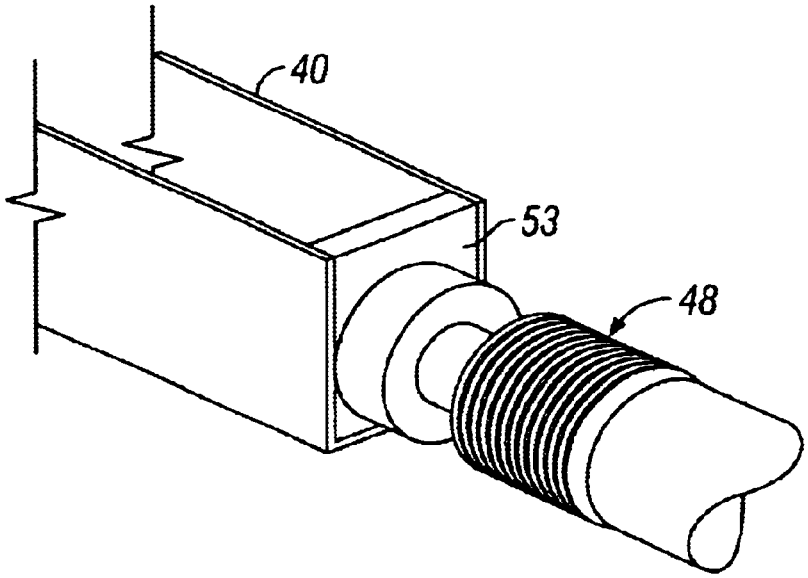
FIG. 6 is a partial perspective view of the cable side of the potting box of FIG. 5.

The housing 14 may consist of two primary components, namely a cable holder 48 and an outer shell 40. The cable holder, shown generally in FIG. 4, forms the threaded portion 26 and the back plate 28. As can best be seen in FIGS. 3, 5, and 6, the outer shell 40 defines the hollow inner cavity 42, which houses the interconnection between the power cord 16, the temperature control device 18 and the heating element 12. The outer shell 40 may include removable end plates 51, 53 that seal around the heating element 12 and the cable holder 48, respectively. The end plate 51 and the main portion of the outer shell 40 define openings 55 that clamp around the ends of the heating element 12. The bottom of the potting box 50 defines a slot 57, which is configured to receive and support the feedback strap 44 such that the strap 44 is exposed to the contents of the tank. It will be appreciated that while the housing can take other forms from that shown. For example, the housing can be circular in cross-section, instead of round as shown.

The heating element 12 consists of a standard cal rod element, except that the two rods preferably are squeezed together to minimize their combined maximum outer cross-section dimension. As will be appreciated, the cal rods should be "cold ended" adjacent the housing to protect the housing 14 from damage due to overheating. Other types of heating rods, such as cast aluminum, could also be employed. In addition, the diameter of the heating rods could be reduced by forming the heating rod of two separate elements which are interconnected at their distal ends, e.g., by a wire or other conductive connector. As will be appreciated, this interconnection is sealed against moisture infiltration, e.g., with epoxy. The two elements could also remain electrically attached before sealing with epoxy.

As is shown generally in FIG. 1, the distal end of the heating element can be supported above the bottom of the tank 20 by a support member 58 that is connected to the heating elements after they are inserted through the drain plug opening 23.

The materials used to construct the heater may be as follows:

1. Nut and potting box 50: plastic.
2. Heating element 12: incoly or cast aluminum.
3. Thermal feedback strap 44: copper or aluminum.
4. Thermostat 18: bimetal disc type.

It should be noted that the entire unit could also be made of cast aluminum.

Figure 11:
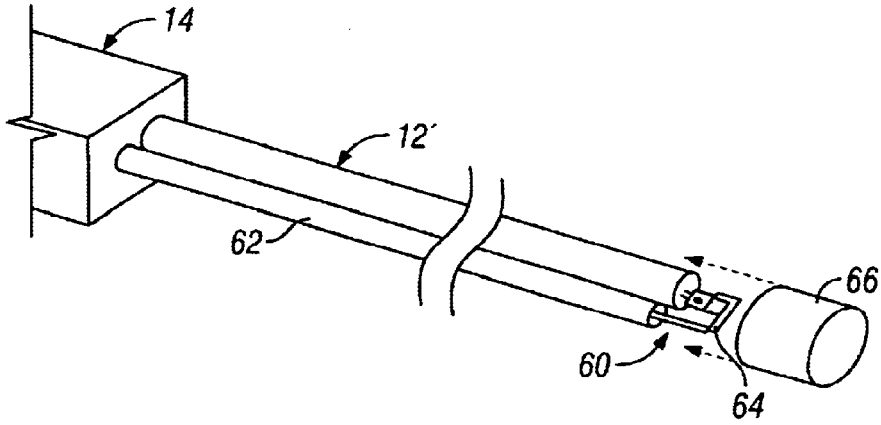
FIG. 11 illustrates certain aspects of an alternate embodiment of the water tank heater.

FIG. 11 illustrates an alternative embodiment of a drain plug heater in accordance with certain aspects of the present invention. This alternative design is directed to reducing the overall cross-section width of the heating element 12. In this embodiment, the heating element 12 is not looped back on itself as was done in the design of FIG. 1. Instead, an insulated wire 60 is fed through a small diameter tube 62. The wire 54 is electrically connected between the distal end of the heating element 12 and the power cord 16 to complete the electrical circuit. A connector 64 may be used to interconnect the wire 60 and the heating element 12. A second potting box 66 is filled with epoxy to encapsulate the interconnection between the heating element 12 and the wire 60, thereby sealing this junction against moisture infiltration. Another alternative (not shown) is to provide a second, reduced diameter heating element in place of the wire 60 and tube 62.

Although the invention has been described with reference to preferred embodiments, workers skilled in the art will recognize that changes may be made in form and detail without departing from the scope and spirit of the invention.

While the invention has been described with reference to certain embodiments, it will be understood by those skilled in the art that various changes may be made and equivalents may be substituted without departing from the scope of the invention. In addition, many modifications may be made to adapt a particular situation or material to the teachings of the invention without departing from its scope. Therefore, it is intended that the invention not be limited to the particular embodiment disclosed, but that the invention will include all embodiments falling within the scope of the appended claims.

What is claimed is:

1. An electric water heating apparatus for mounting in a water tank having a drain plug opening, comprising:

a housing having a back wall which is larger than the drain plug opening and a body portion extending from the back wall, the body portion being sized for insertion through the drain plug opening and including a threaded portion;

an electric heating element extending from the end of the body portion opposite the back wall, the heating element being sized for insertion through the drain plug opening and being configured for immersion into the contents of the tank;

a male electric plug adapted for connection a conventional electrical outlet;

a power cord having first end mechanically and electrically connected to the male plug and a second end extending into the housing through the back plate and being electrically interconnected with the heating element for delivering power thereto;

a nut adapted to thread onto the threaded portion of the housing from inside the tank to secure the heating element within the tank;

a seal adapted to seal the drain plug opening around the housing to prevent leakage therethrough; and a temperature regulating device interconnected between the power cord and the heating element, the temperature regulating device being adapted to regulate the heating element so as to maintain the content of the tank within a preselected temperature range.

2. A water heater as set forth in claim 1, wherein the seal comprises an annular washer which is compressed between the water tank side wall and the back wall as the nut is threaded onto the threaded portion.

3. An electric water heater as set forth in claim 1, wherein the body portion of the housing has a maximum outer cross-sectional dimension that is less than 0.75 inches.

4. An electric water tank heater as set forth in claim 1, wherein the heater is mountable through drain plug openings ranging from 0.75 inches in diameter to 2.0 inches in diameter.

5. An electric water heating apparatus for mounting in a water tank having a drain plug opening, comprising:

a housing having an enlarged portion which is larger than the drain plug opening and a body portion extending from the enlarged portion, the body portion being sized for insertion through the drain plug opening and including a threaded portion;

an electric heating element extending from the end of the body portion opposite the enlarged portion, the heating element being sized for insertion through the drain plug opening and being configured for immersion into the contents of the tank;

a power cord having first end mechanically and electrically connected to a male plug and a second end extending into the housing and being electrically interconnected with the heating element for delivering power thereto; and a nut adapted to thread onto the threaded portion of the housing from inside the tank to secure the heating element within the tank.

6. A water heater as set forth in claim 5, further comprising a seal adapted to seal the drain plug opening around the housing to prevent leakage therethrough.

7. A water heater as set forth in claim 6, wherein the seal comprises a seal which is compressed between the water tank and the enlarged portion of the housing as the nut is threaded onto the threaded portion.

8. An electric water heater as set forth in claim 5, wherein the body portion of the housing has a maximum outer cross-sectional dimension that is less than 0.75 inches.

9. An electric water tank heater as set forth in claim 5, wherein the heater is mountable through drain plug openings ranging from 0.75 inches in diameter to 2.0 inches in diameter.

10. An electric water tank heater as set forth in claim 5, further comprising a temperature regulating device interconnected between the power cord and the heating element, the temperature regulating device being adapted to regulate the heating element so as to maintain the contents of the tank within a preselected temperature range.

11. An electric water heating apparatus for mounting in a water tank having a drain plug opening, comprising:

a housing having an enlarged portion which is larger than the drain plug opening and a body portion extending from the enlarged portion, the body portion being integrally formed with the enlarged portion, sized for insertion through the drain plug opening, and including a threaded portion;

an electric heating element extending from the end of the body portion opposite the enlarged portion, the heating element being size for insertion through the drain plug opening and being configured for immersion into the contents of the tank;

a power cord having first end mechanically and electrically connected to a male plug and a second end extending into the housing and being electrically interconnected with the heating element for delivering power thereto; and a nut adapted to thread onto the threaded portion of the housing from inside the tank to secure the heating element within the tank.

* * * * *